United States Patent [19]

Thatcher et al.

[11] Patent Number: 4,646,759

[45] Date of Patent: Mar. 3, 1987

[54] VIBRATING TROUGH TOBACCO SEPARATOR AND CLASSIFIER

[75] Inventors: Richard E. Thatcher, Chester; Louis R. Turano, Colonial Heights, both of Va.

[73] Assignee: Philip Morris Incorporated, New York, N.Y.

[21] Appl. No.: 569,013

[22] Filed: Jan. 6, 1984

[51] Int. Cl.[4] ..... A24B 3/18; A24C 5/00

[52] U.S. Cl. ..... 131/110; 131/108; 131/109.2; 131/109.3; 198/766; 209/474; 406/89; 406/138; 406/142

[58] Field of Search ..... 131/110, 108, 109.2, 131/109.1, 109.3; 406/85, 89, 91, 95, 138, 142; 198/766; 209/423, 454, 474, 460, 467

[56] References Cited

U.S. PATENT DOCUMENTS

| | | | |
|---|---|---|---|
| Re. 29,625 | 5/1978 | Summers | 209/469 |
| 2,658,617 | 11/1953 | Rowell | 209/137 |
| 2,825,457 | 3/1958 | Rowell | 209/139 |
| 2,941,667 | 6/1960 | Hilgartner, Jr. et al. | 209/134 |
| 3,010,576 | 11/1961 | Harte et al. | 209/35 |
| 3,095,883 | 7/1963 | Morris | 131/84 |
| 3,116,238 | 12/1963 | Van Etten | 209/250 |
| 3,164,548 | 1/1965 | Rowell et al. | 209/139 |
| 3,229,377 | 1/1966 | Hoyt | 34/10 |
| 3,261,463 | 7/1966 | Eveson et al. | 209/11 |
| 3,262,457 | 7/1966 | Gambreni | 131/110 |
| 3,402,814 | 9/1968 | Morel et al. | 209/127 |
| 3,447,950 | 6/1969 | Evans et al. | 117/100 |
| 3,482,328 | 12/1969 | Larkham | 34/57 |
| 3,511,843 | 5/1970 | Lewis | 260/291 |
| 3,542,037 | 11/1970 | Pietralunga | 131/109 |
| 3,593,851 | 7/1971 | Davidson | 209/133 |
| 3,608,716 | 9/1971 | Rowell et al. | 209/139 R |
| 3,661,159 | 5/1972 | Pietrucci | 131/146 |
| 3,724,090 | 4/1973 | Smith, Jr. | 34/57 D |
| 3,904,517 | 9/1975 | Wilson | 209/441 |
| 3,914,876 | 10/1975 | Callcott | 34/57 A |
| 3,939,694 | 2/1976 | Guichard et al. | 73/28 |
| 3,945,915 | 3/1976 | Wilson | 209/12 |
| 3,997,433 | 12/1976 | Liu et al. | 209/5 |
| 4,045,334 | 8/1977 | Ferrary et al. | 209/141 |
| 4,055,486 | 10/1977 | Choi et al. | 209/11 |
| 4,071,960 | 2/1978 | Bowles | 34/57 A |
| 4,083,499 | 4/1978 | Thatcher | 241/24 |
| 4,089,422 | 5/1978 | Harmke et al. | 209/137 |
| 4,109,394 | 8/1978 | Hoyt | 34/57 B |
| 4,116,203 | 9/1978 | Wochnowski | 131/138 |
| 4,148,325 | 4/1979 | Solomon et al. | 131/134 |
| 4,154,585 | 5/1979 | Melcher et al. | 55/99 |
| 4,201,499 | 5/1980 | Buske et al. | 406/75 |
| 4,206,046 | 6/1980 | Haight | 209/481 |
| 4,221,035 | 9/1980 | Thatcher | 209/44.1 |
| 4,233,996 | 11/1980 | Brackmann et al. | 131/140 R |
| 4,236,318 | 12/1980 | Heard et al. | 34/10 |
| 4,246,836 | 1/1981 | Smith, Jr. | 99/478 |
| 4,270,553 | 6/1981 | Conrad et al. | 131/291 |
| 4,274,947 | 6/1981 | Beeckmans et al. | 209/12 |
| 4,278,100 | 7/1981 | Thatcher | 131/196 |
| 4,306,359 | 12/1981 | Hoyt | 34/57 A |
| 4,330,400 | 5/1982 | Schmidt | 209/474 |
| 4,338,705 | 7/1982 | Jones | 19/80 R |
| 4,345,858 | 8/1982 | Barlow | 406/34 |
| 4,390,029 | 6/1983 | Leckband et al. | 131/109.3 |
| 4,409,098 | 10/1983 | Burke | 209/172.5 |

FOREIGN PATENT DOCUMENTS

| | | |
|---|---|---|
| 1262620 | 4/1961 | France . |
| 953792 | 4/1964 | United Kingdom . |
| 953861 | 4/1964 | United Kingdom . |
| 953862 | 4/1964 | United Kingdom . |

*Primary Examiner*—V. Millin

*Attorney, Agent, or Firm*—Jeffrey H. Ingerman

[57] ABSTRACT

A method and apparatus are disclosed for the separation and classification of tobacco into two fractions, e.g., into heavies and lights. A stream of fluid is employed to produce a stratified bed of the tobacco, preferably in cooperation with vibration of the tobacco, in which the tobacco is supported by the fluid and is stratified as a function of particle size, density and weight. The stream entrains the tobacco particles located at the top of the stratified bed and removes them to a suitable receptacle, where they are received and collected.

20 Claims, 17 Drawing Figures

VIBRATING TROUGH TOBACCO SEPARATOR AND CLASSIFIER

BACKGROUND OF THE INVENTION

The technical field of the present invention is generally the field of tobacco processing, and is more particularly the field of separating and classifying tobacco according to particle size, and of removing impurities from tobacco.

Cut tobacco intended for use as cigarette filler often contains impurities that, if not removed, can lower the quality of a cigarette made from the tobacco. Such impurities include sand and other nontobacco particles. Small pieces of stem, produced when the tobacco is cut into long, thin pieces of filler, can also reduce the quality of cigarettes produced from the tobacco.

Many devices for classifying tobacco according to particle size and weight are known. Such devices, however, tend to damage the tobacco while processing it. Indeed, with expanded tobacco and other delicate materials, degradation of the product is virtually inevitable with conventional machines. In addition, many such devices are not efficient enough to extract the maximum amount of usable filler in only one or two passes, requiring that some fraction of the tobacco be processed as many as eight or ten times before a satisfactory degree of separation is achieved.

It is the object of the invention to provide a method and apparatus for separating and classifying tobacco, especially cut tobacco filler, whole leaf tobacco and expanded tobacco, according to particle size, weight and shape.

It is another object of the invention to provide such a method and apparatus in which the tobacco is processed without passing through a winnower or an air lock.

It is another object of the invention to provide such a method and apparatus capable of processing very delicate material, such as expanded tobacco, without significant degradation of the material.

It is still another object of the invention to provide such a method and apparatus that use a stream of air for separation and that require a lower maximum air speed than is common in conventional air separators.

It is another object of the invention to provide such a method and apparatus that produce a lower level of noise than do conventional air separators.

It is yet another object of the invention to provide such a method and apparatus that can separate two classes of material differing only slightly in their characteristics.

SUMMARY OF THE INVENTION

The method of the invention comprises separating heavy particles ("heavies"), particularly those comprising sand or pieces of a tobacco leaf stem, from a mass of cut tobacco to produce cigarette filler of a quality desirable for use in cigarettes, by passing a stream (hereinafter the "stratifying stream") of a fluid through the cut tobacco to produce a stratified bed of tobacco, the stratifying stream also entraining the light particles ("lights") and raising them to the top of the stratified bed, from which they can be removed easily. The entrained lights are then removed from the stratified bed by the fluid stream and are released into a collection chamber, or receiver. Either the lights or the heavies or both can if desired be processed in this manner a second time to achieve a higher degree of separation of the two classes of particles.

The apparatus of the invention is a tobacco separator, classifier and receiver comprising a stratification chamber, means of introducing tobacco into the chamber, means for introducing a stratifying stream of a fluid into the chamber to produce a stratified bed of tobacco therein and for entraining a desired class of tobacco pieces (e.g., the lighter pieces of the tobacco), and receiver or collection means for receiving the entrained tobacco.

Preferably, a degree of lateral motion is imparted to the tobacco in the stratified bed by means of slightly inclining and vibrating the floor of the stratification chamber.

Other features and advantages of the invention will be understood from a consideration of the following detailed description of the preferred embodiments thereof, taken in conjunction with the accompanying figures, in which like references characters refer to like elements throughout.

DETAILED DESCRIPTION OF THE PREFERRED EMBODIMENTS

Figure 1:
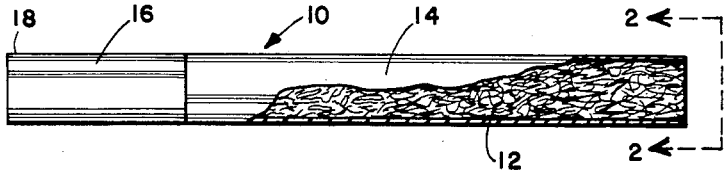
FIG. 1 is a side view, partly cut away, of a filter cigarette, showing the filler.
Figure 2:
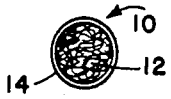
FIG. 2 is an end view of the cigarette of FIG. 1, taken from line 2—2 of FIG. 1.
Figure 3:
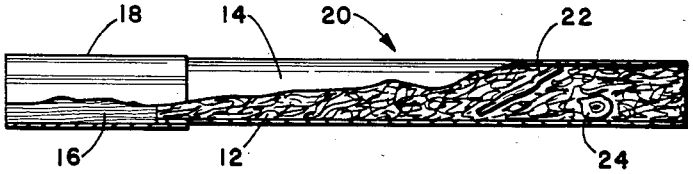
FIG. 3 is a partially cut away side view of a filter cigarette, showing various types of undesirable impurities in the filler.
Figure 4:
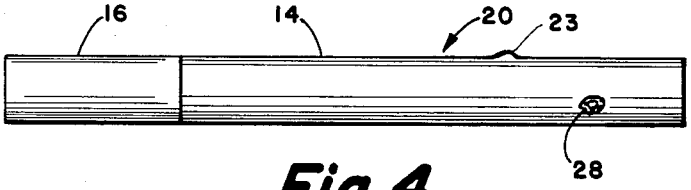
FIG. 4 is a side view of a filter cigarette, showing defects due to such impurities in the filler.
Figure 5:
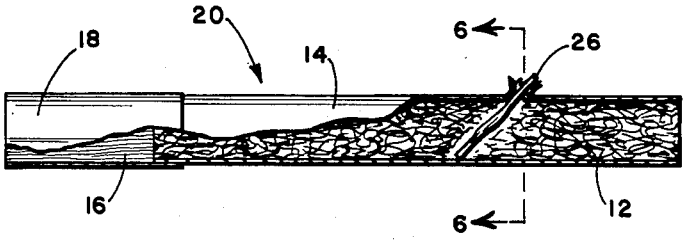
FIG. 5 is a partially cut away side view of a filter cigarette with a rupture in the cigarette paper.
Figure 6:
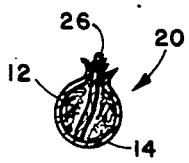
FIG. 6 is a sectional view taken from section line 6—6 of FIG. 5.

As shown in FIGS. 1 and 2, a typical filter cigarette 10 includes a rod of tobacco filler 12 wrapped in cigarette paper 14, with a filter 16 secured to one end by means of tipping paper 18. For the cigarette 10 to be of a high quality, the filler 12 should be of uniform quality, as shown in FIGS. 1 and 2, and should contain no impurities. FIG. 3 shows a cigarette 20 containing defects including a piece of tobacco leaf stem 22 and a birdseye 24 (a cross-cut piece of stem) in the filler 12. Defects of this kind are undesirable. The stem 22 is capable of producing a surface irregularity 23 in the cigarette, as shown in FIG. 4, also, a piece of stem 26 is capable of puncturing the cigarette paper, as shown in FIGS. 5 and 6. In addition, when the cigarette is smoked, a birdseye can create a hot spot which, if adjacent to the cigarette paper, can burn through the paper. Excess moisture on a birdseye can also contaminate the filler, and can create a spot 28 on the cigarette wrapper, giving the cigarette an undesirable appearance.

Figure 7:
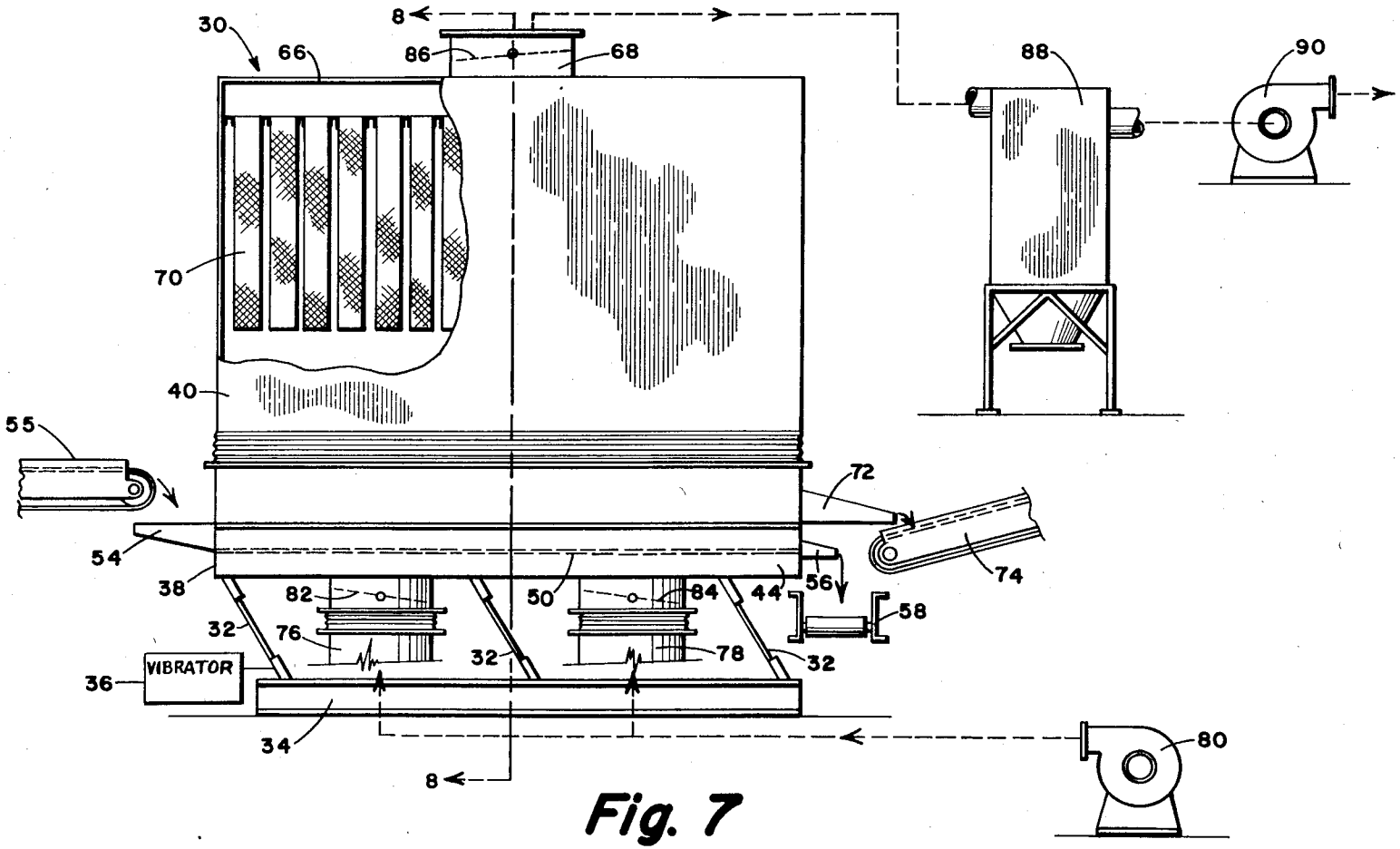
FIG. 7 is a side elevational view of one preferred embodiment of the apparatus of the invention.
Figure 8:
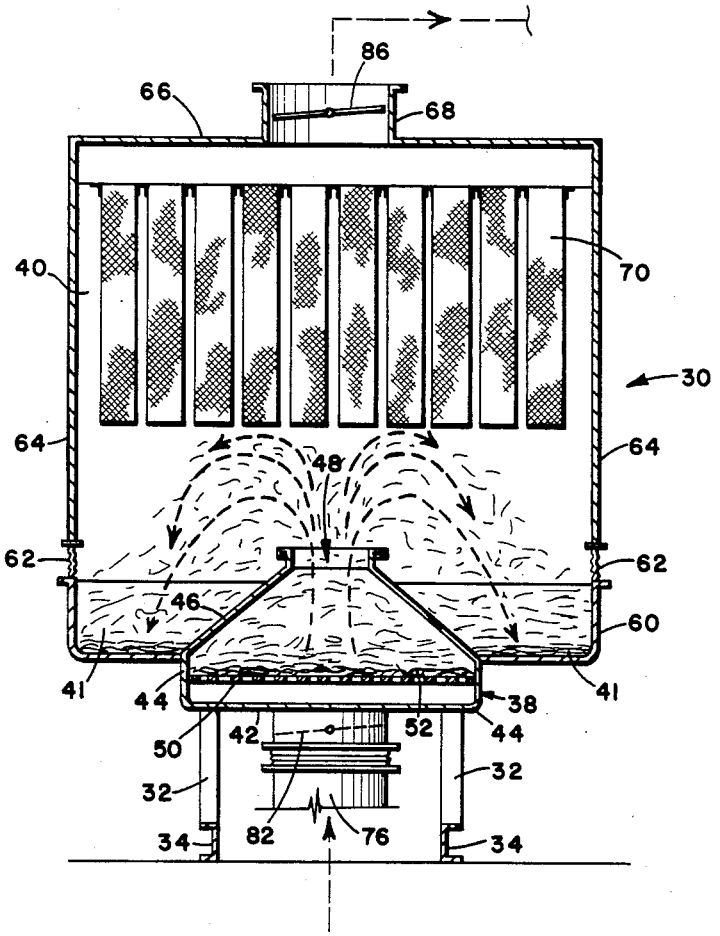
FIG. 8 is a cross-sectional view taken from section line 8—8 of FIG. 7.

As shown in FIGS. 7 and 8, the first preferred embodiment of the apparatus of the invention comprises what will be termed a double separator unit 30, because two streams of fluid are used in sequence to stratify and clarify the tobacco, as described below.

The double unit 30 is supported for vibration on six inclined legs 32 mounted on a base 34. The vibratory motion is provided by any suitable known mechanism (indicated schematically at 36 in FIG. 7), and preferably includes a longitudinal component of motion (i.e., left to right in FIG. 7), and preferaby also includes either a vertical or a transverse horizontal component, or both. The double separator unit 30 includes a stratification chamber 38, and an upper chamber 40 comprising one or more receptacles or collectors 41. The stratification chamber 38 has a flat bottom 42 and relatively low vertical sides 44. Inclined surfaces 46 define the roof of the stratification chamber, converging toward each other and defining a relatively narrow throat 48 at the top center of the stratification chamber 38, by which the latter communicates with the interior of the upper chamber 40. The throat 48 extends along the entire length of the stratification chamber 38. A perforated plate, mesh or other similar element 50 spaced from the floor 42 of the stratification chamber 38 serves as the bottom of the stratified bed 52 of tobacco that is created by the stratifying streams of fluid. Preferably, the plate 50 is inclined at a small angle to the horizontal, to encourage movement of material from one end of the double separator unit 30 to the other.

The upstream end of the double separator unit 30 (the left-hand end in FIG. 7) has a lip-shaped infeed tray 54, where the tobacco to be processed is introduced into the machine. An infeed conveyor 55 is provided to deposit cut tobacco or other material to be processed onto the infeed tray 54 at the upstream end of the unit 30. At the downstream end, a spout 56 serves as an outlet to deliver material from the vibrating stratification chamber 38 onto a conveyor 58 for removal.

The upper chamber 40, as can be seen most clearly in FIG. 8, includes a low, relatively shallow tray portion 60 secured to the tops of the upright walls 44 of the stratification chamber 38. The tray portion 60 serves as the receiver in which pieces of tobacco removed from the stratification chamber 38 are collected. A selvedge strip 62 joins the top of the tray walls 44 to an upper wall 64, which defines the upper part of the sides of the upper chamber housing. The top of the upper chamber 40 is covered by a roof 66, except for an exhaust opening surrounded by a chimney 68. Dust bags 70 are suspended or otherwise supported, preferably in a regular array of lines and rows, in the upper part of the housing 40. These bags 70 preferably are circular in cross section, and can be made of fabric, or of wire or plastic mesh. Each is preferably several inches in diameter, and adjacent bags are preferably separated by no more than a few inches. The bags help to maintain the quality of the product collected in the receiver, in a manner described below.

A second spout 72 is provided at the downstream end of the receiver tray 60 to deposit material collected therein onto an adjacent filler discharge conveyor 74. The vibration of the stratification chamber 38 is transmitted to the tray portion 60 of the upper chamber 40, helping to move the collected product to the spout 72.

In the embodiment of FIGS. 7 and 8, two stratifying streams of fluid are used. Rising streams of air or other fluid are provided at the bottom of the unit 30 via each of two inlets 76, 78 by suitable conventional fan equipment 80. The flow speed of each stream is controlled independently by pivotable dampers 82, 84 in the inlets 76, 78. The streams are propelled upward into the stratification chamber 38 through the two inlets 76, 78 and upward through the perforated plate 50. Particulate matter on or above the plate 50 is agitated by the streams and by the vibrations of the housing. This produces a stratified fluidized bed 52 of the particulate matter.

The air or other fluid is removed from the top of the double separator unit 30 by exhaust chimney 68, also provided with a pivotable damper 86. The exhaust air normally contains dust and is therefore passed though a suitable conventional dust collector unit 88. An exhaust fan system 90 separate from the fan 80 can be used for this purpose as shown in FIG. 7, or a closed cycle system can be used.

Figure 9:
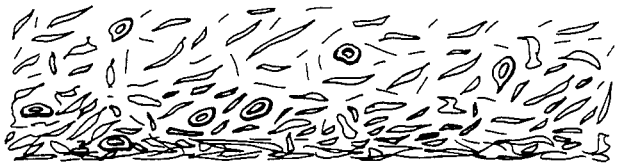
FIGS. 9-11 are views illustrating the stratified bed of tobacco produced inside the apparatus of FIG. 7.

Cut tobacco is provided by the infeed conveyor 55 to the upstream end of the double separator unit 30. The vibration of the unit 30 and the slope of the perforated plate 50 cause the material to move forward through the unit (from left to right in FIG. 7). The cut tobacco typically includes filler mixed with stems and birdseyes, as well as possibly other types of undesirable material. Such a mixture is shown in FIG. 9.

Figure 10:
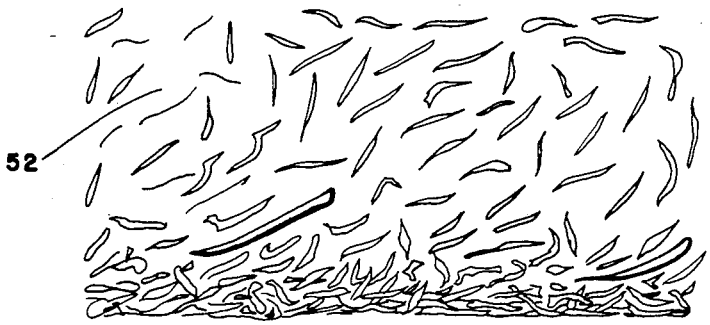

The streams of air rising through the plate 50 lift the lighter particles away from the heavier, supporting the particles and stratifying them according to density, size and other characteristics, as shown in FIG. 10. Typically, the particles most desirable for use as cigarette filler rise to the upper portion of the stratified bed 52 of tobacco, while stems and other undesirable material remain at the bottom. According to the invention, the desirable material at the top is removed from the stratified bed 52 and is collected, while the undesirable material is left in the bed 52, from which it is eventually discharged onto the waste conveyor 58.

According to the invention, the fluid of the stratifying streams rises through the throat 48 of the stratification chamber 38, increasing in velocity as the width of the chamber 38 narrows toward the top. The high-velocity fluid pulls the light filler material up through the throat 48 and into the upper collector chamber 40. As the united fluid stream enters the much wider upper chamber 40, the stream decreases in velocity, depositing the entrained filler into the collector tray 60, or receivers, as indicated by the dashed arrows in FIG. 8. The vibration and inclination of the plate or mesh 50 move the filler collected in this manner to the downstream end of the double separator unit 30, where it is deposited by the spout 72 onto the filler discharge conveyor 74.

Figure 11:
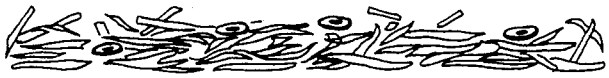

Only the heavier particles, the stems and birdseyes, are left in the stratification chamber 38, as shown in FIG. 11.

The dust bags 70 keep the desirable pieces of filler from being drawn out the exhaust chimney 68 of the separator unit 30, and thus aid in preventing product degradation that would occur if the filler were to pass through the dust collector 88 or the exhaust fan 90.

It has been found desirable to introduce the first stratifying stream into the stratification chamber via inlet 76 at a relatively low speed sufficient to stratify the tobacco on the plate 50 in cooperation with the vibration of the separator unit 30, and to introduce the second stream via inlet 78 at a higher speed to entrain and remove the particles at the top of the stratified bed 52.

Figure 12:
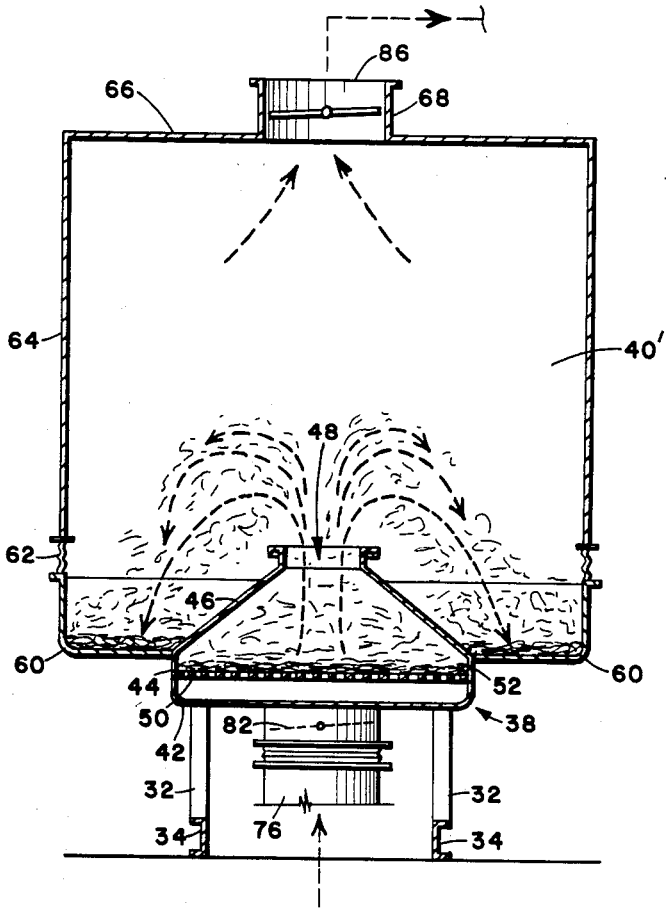
FIG. 12 is a view similar to that of FIG. 8, showing a second preferred embodiment of the apparatus of the invention.

In a second preferred embodiment, shown in FIG. 12, no dust bags or other objects are disposed in the upper part of the collection chamber 40'. This embodiment functions in much the same manner as does the first, but is intended for use in processing whole leaf to separate leaves from pads (clumps of leaves) and to aid in breaking up pads. The dust bags of FIGS. 7 and 8 are unnecessary in this embodiment because of the relatively large size of the "particles" being processed (i.e., whole leaves and pads).

Figure 13:
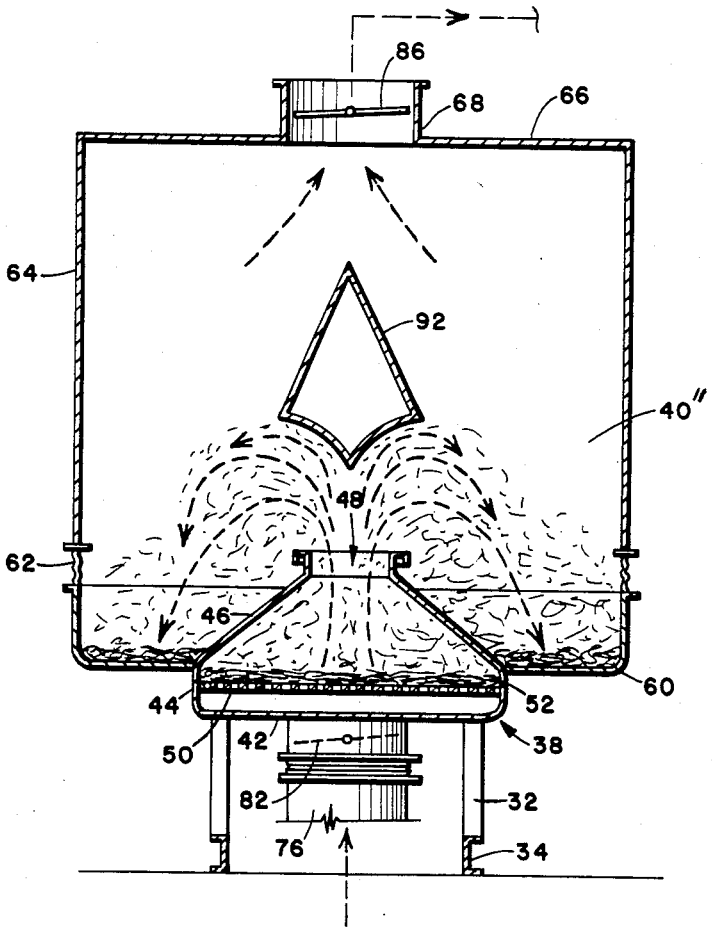
FIG. 13 is a view similar to that of FIG. 8, showing another preferred embodiment of the apparatus of the invention.

A third preferred embodiment, also intended chiefly for use in processing whole leaf, is shown in FIG. 13. This embodiment has a baffle 92 positioned in approximately the center of the upper chamber 40''. The baffle 92 runs the length of the upper chamber 40'' and is positioned directly above the throat 48 of the stratification chamber 38. As shown, the cross-section of the baffle 92 is shaped somewhat like an arrowhead. The undersurface of the baffle 92 is approximately V-shaped, with the vertex of the "V" downward and with the legs of the "V" somewhat curved to be concave downward. The upper surfaces of the baffle 92 form a sharper "V", the exact shape of which is chosen to aid the flow of air to the exhaust chimney 68. This embodiment is particularly well suited for separating whole leaf tobacco of a delicate nature, for example, oriental leaf, from contaminants commonly present with leaf tobacco of that type, and for separating individual leaves from pads. Cleaning of such tobacco according to the invention is accomplished efficiently and without degradation of the leaf, in contrast to the use of previously known methods and equipment.

For processing whole leaf or other relatively large particles, the stratified bed must be deeper than for cut filler in order to achieve good separation. Otherwise, the phenomenon of "piggy-backing" may occur, wherein two or more particles become partially entangled with each other and move as a unit, preventing proper separation. To achieve the desired result, it has been found very effective to decrease the internal height of the stratification chamber from a maximum at the input end to a minimum at the output end. In the portion of the stratification chamber near the infeed, the relatively great height aids in the thorough stratification of the particulate matter in the chamber. Lowering the roof of the chamber at the opposite end of the chamber, and thus lowering the throat, causes the rising air to enter the throat at a lower point, hastening the entrainment of the particles supported in the upper portions of the stratified bed. In addition, the second stream of rising fluid is supplied at a higher velocity than the first, to aid in entrainment.

Figure 14A:
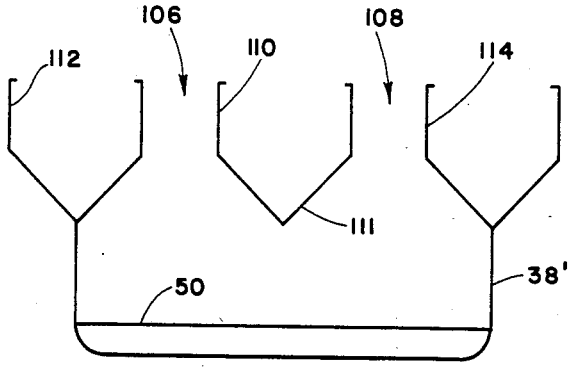
FIGS. 14A and 14B are cross-sectional views of the stratification chamber of another preferred embodiment of the apparatus of the invention.
Figure 14B:
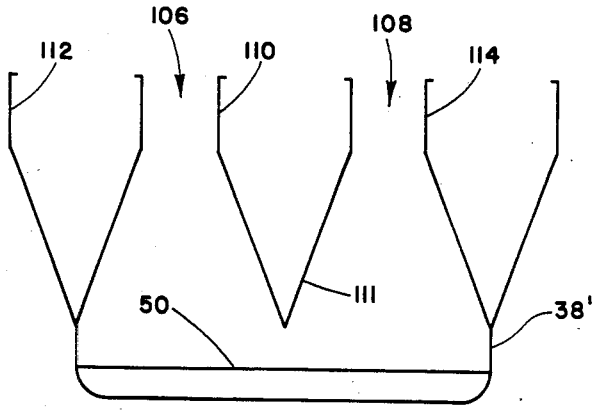

In another embodiment, the stratification chamber of which is shown in section in FIGS. 14A and 14B, two parallel throats 106, 108 are provided at the top of the stratification chamber 38'. The two throats are separated by a trough 110 whose V-shaped bottom surface 111 defines one side of the converging portion of each throat 106, 108. Additional troughs 112, 114 preferably having approximately the same shape as the first are located along each side of the stratification chamber 38', on the same level as the first trough 110. The three troughs 110, 112, 114 serve as the receiver for the tobacco pieces removed from the lower chamber 38' by the stratifying streams rising through the throats 106, 108. The troughs 110, 112, 114 are deeper at the output end of the double separator unit (FIG. 14B) to aid in the entainment of particles in the upper portion of the stratified bed, as described above. For example, for processing whole leaf tobacco, the bottom of each trough 110, 112, 114 can be about eight inches above the plate or mesh 50 supporting the stratified bed at the input end of the double unit (FIG. 14A), and about two inches at the other end (FIG. 14B), the spacing decreasing gradually along the length ofthe stratification chamber 38'.

The central trough 110 is preferably supported at both ends and if desired can also be supported from below by a vertical panel (not shown) in the stratification chamber 38', dividing the latter into two parallel chambers.

Figure 15:
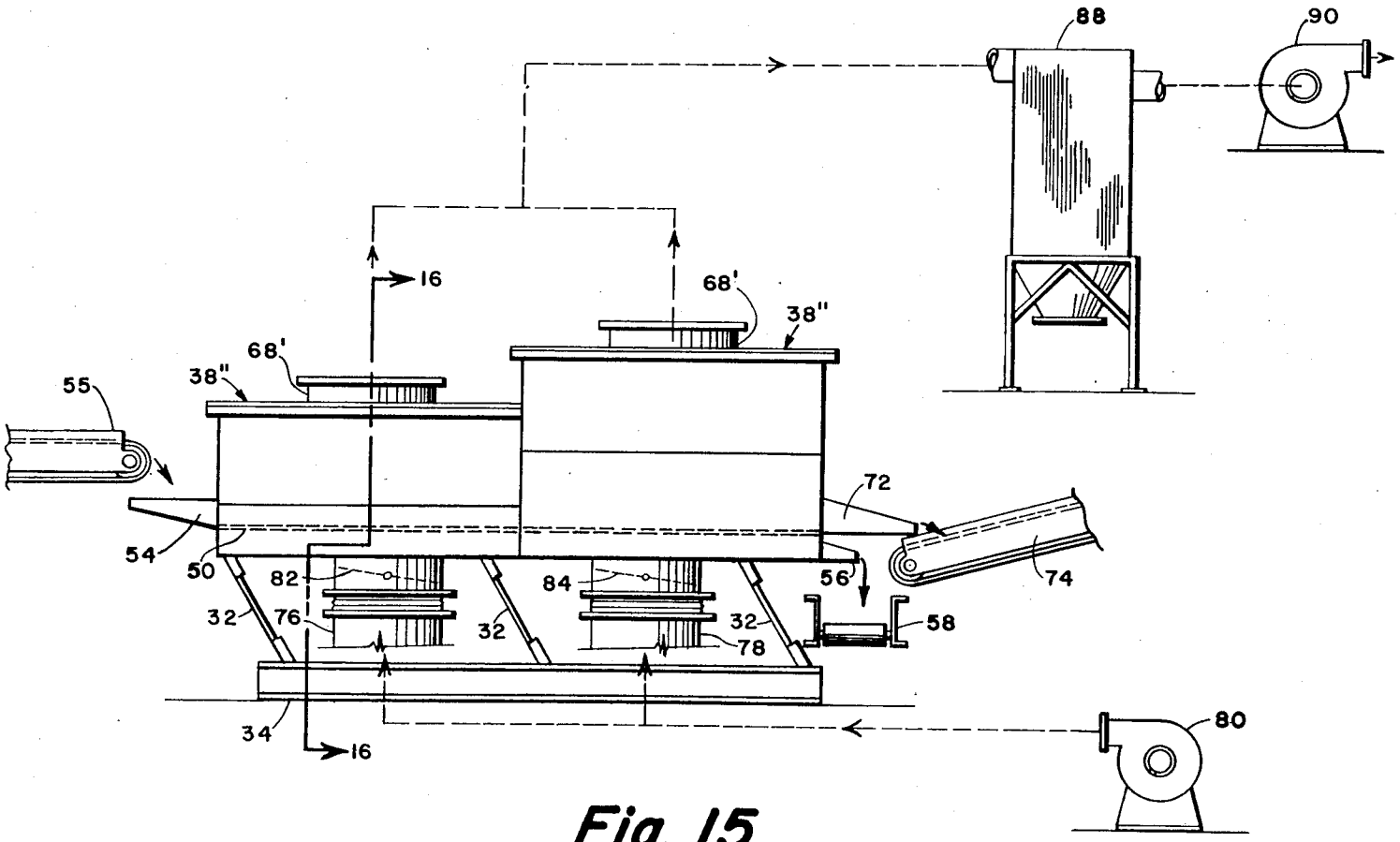
FIG. 15 is a side elevational view of another preferred embodiment of the apparatus of the invention.
Figure 16:
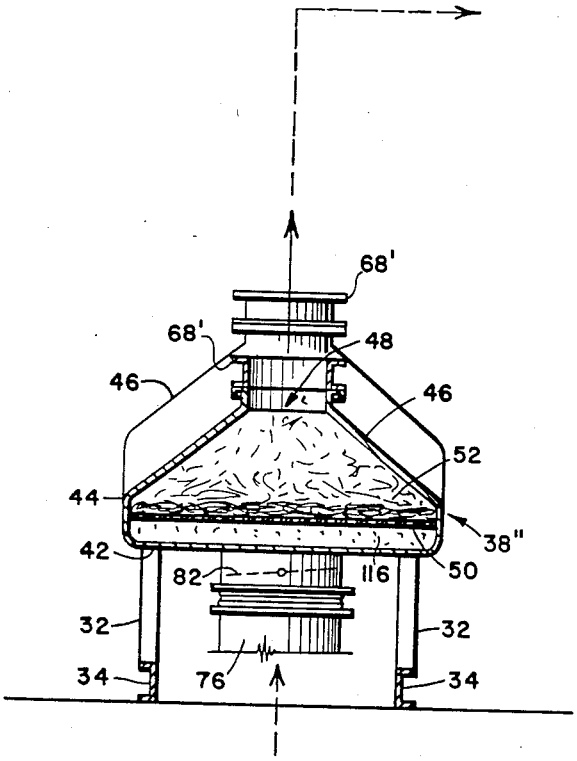
FIG. 16 is a view taken from section line 16—16 of FIG. 15.

FIGS. 15 and 16 show yet another preferred embodiment of the invention lacking the collector tray and the upper chamber of the embodiments described above. In this embodiment, the exhaust is removed directly from an exhaust chimney or chimneys 68' located at the top of the throat of the stratification chamber. In addition, the height of the walls of the throat 48 above mesh 50 gradually increases toward the output end of the machine (to the right in FIG. 15). This embodiment is particularly suitable for separating cut filler, in the form of tobacco strips, from very fine material such as slivers. In this embodiment, a piece of mesh serves as the base 50 of the stratified bed 52. The particles constituting the mat-like mass of filler mixed with the unwanted material are agitated and separated from each other by the fluid provided through the mesh, in cooperation with the vibration of the unit. The agitation and the rising fluid streams also cause the very fine slivers to assume a roughly vertical orientation, allowing them to fall through the openings in the mesh into the bottom portion 116 of the chamber. The upper ends of the fluid inlets are covered with sufficiently fine screens (not shown) to prevent the debris from falling into the inlets.

The inclination of the mesh 50 to the horizontal and the vibration of the unit move both the slivers and the filler toward the downstream end of the unit, where they are deposited by respective spouts onto offtake conveyors, respectively, as shown.

In addition to being suitable for the separation of filler or delicate oriental leaf from unwanted material as described above, the invention is very well adapted for the treatment of highly friable materials such as expanded tobacco. Unlike standard air separators, which are not readily able to separate a desired and an unwanted fraction of expanded tobacco because of the slight difference in weight between the fractions, the present invention is able to separate the two reasonably efficiently.

The ratio of the throat width to the maximum width of the stratification chamber is preferably between 1 to 1 and 1 to 4, most preferably about 1 to 3. Other ratios are possible, however, and any ratio which permits the machine to function as described herein falls within the scope of the invention.

The inclination of the stratification bed to the horizontal is selected as a function of the desired speed of the product through the machine. The exact angle is a function of the product and of the manner in which the product moves along the bed, as well as the desired throughput and the length of the machine. Generally, angles in the range 0°–8° have been found suitable. The invention, however, is by no means limited to these angles but encompasses any inclination at which the process of the invention can be performed.

In the double-unit devices shown, as already stated with regard to the embodiment of FIG. 7, the first stratifying stream preferably has a lower velocity than the second. The first stream has a velocity sufficient to stratify the material being treated. The second has a higher velocity, and it is here that the actual separation is chiefly performed.

Typical stratifying steam velocities found suitable with cut filler tobacco are 300 feet per minute for the first stream, and 450–500 feet per minute for the second stream.

Another advantage of the invention is that the air velocities used are not as great as those that occur in typical air separators. Unlike the latter, in which air velocities of 4000 to 6000 feet per minute are often attained, much lower maximum velocities are suitable for use with the invention, for example, on the order of 1200 feet per minute in the throat. The fluid velocities in the stratified bed are much lower still, and the tobacco in any given region in the apparatus is not believed to move as quickly as the surrounding fluid.

Another advantage of the lower velocities (besides lower power requirements) is that the tobacco need not be subjected to the great decelerations and attendant damage that occur in a conventional tangential separator system.

Where separate supply and exhaust fans are used, as shown, it is preferable to balance the supply and the exhaust of the stratifying fluid streams to provide the equivalent of a closed fluid cycle system.

With the invention, there is no need to pass the tobacco through a winnower or airlock. As a result, the sometimes severe degradation suffered by tobacco from such devices is avoided.

It has been found that the method and apparatus of the invention separate tobacco with high efficiency, and with such gentleness that there is no significant degradation of the tobacco.

Although the invention has been described in detail with reference to several illustrative embodiments thereof, many modifications and variations thereof will now be apparent to those skiled in the art. Accordingly, the scope of the invention is to be limited, not by the details illustratively described herein, but only by the terms of the appended claims.

What is claimed is:

1. A process for treating tobacco, comprising the steps of: separating undesired material from a mass of tobacco by passing a stratifying stream of a fluid through the tobacco to produce a stratified bed of the tobacco in which the tobacco is supported by said fluid and is stratified into layers according to the size, shape and weight of each piece of tobacco; removing desired pieces of tobacco from the upper portion of the stratified bed; and receiving and collecting the removed pieces of tobacco in a receiver at a location remote from the stratified bed of tobacoo.

2. The process of claim 1, wherein the collecting step comprises depositing the removed tobacco in a trough.

3. The process of claim 1, wherein the removing step is achieved by moving the stratifying stream through the stratified bed and through a throat immediately above the stratified bed and narrower than the stratified bed, to entrain the desired pieces of tobacco from the upper portion of the stratified bed.

4. The process of claim 3, further comprising decelerating the stream after the stream has passed through the throat, for causing the stream to release the tobacco.

5. The process of claim 4, further comprising vibrating a receptacle receiving the removed pieces of tobacco, in order to move the tobacco inside the receptacle toward an outlet.

6. The process of claim 5, further comprising removing dust by means of suction.

7. The process of claim 6, further comprising preventing the removed pieces of tobacco from being removed with the dust, by interposing blocking means between the throat and the source of the suction.

8. The process of claim 1, wherein the tobacco comprises cut filler and the removed pieces of tobacco are pieces most desirable for use as cigarette filler.

9. The process of claim 1, wherein the tobacco is a mass of cut expanded tobacco.

10. The process of claim 1, wherein the tobacco is whole leaf, the removed pieces of tobacco are individual leaves and the material left behind in the stratified bed by the stream comprises pads of leaves.

11. A tobacco separator, classifier and receiver system, comprising: a stratification chamber; means for introducing tobacco into said chamber; vibrating means for vibrating said chamber; means for introducing a stratifying stream of a fluid into said chamber to produce in said chamber a bed of tobacco stratified into layers according to the size, shape and weight of each piece of tobacco and for entraining relatively light pieces of such tobacco; and means for receiving pieces of tobacco so entrained.

12. The system of claim 11, wherein said receiving means comprises tray means adjacent said stratification chamber.

13. The system of claim 12, wherein said stratification chamber comprises a floor, said floor being inclined from the horizontal to induce a lateral motion of particles making up a stratified bed in said chamber, in cooperation with vibration of said chamber.

14. The system of claim 12, wherein said stratification chamber has a throat narrower than the maximum width of said stratification chamber, for removing entrained material from said stratification chamber.

15. The system of claim 14, wherein the maximum width of said stratification chamber is between about one time and about four times the width of said throat, inclusive.

16. The system of claim 15, wherein the maximum width of said stratification chamber is approximately three times the width of said throat.

17. The system of claim 14, further comprising baffle means disposed above said throat.

18. The system of claim 17, wherein said baffle means is a unitary element.

19. The system of claim 18, wherein said baffle means comprises an array of spaced apart elements.

20. The system of claim 19, wherein said spaced apart elements are made of plastic mesh.

* * * * *

UNITED STATES PATENT AND TRADEMARK OFFICE

CERTIFICATE OF CORRECTION

PATENT NO. : 4,646,759

DATED : March 3, 1987

INVENTOR(S) : Richard E. Thatcher et al.

It is certified that error appears in the above-identified patent and that said Letters Patent is hereby corrected as shown below:

Column 6, line 16, "ofthe" should be -- of the --.

Column 7, line 14, "steam" should be -- stream --;

line 49, "skiled" should be -- skilled --.

Signed and Sealed this

Second Day of February, 1988

*Attest:*

DONALD J. QUIGG

*Attesting Officer*

*Commissioner of Patents and Trademarks*